US010367307B2

(12) United States Patent
Zhou et al.

(10) Patent No.: US 10,367,307 B2
(45) Date of Patent: Jul. 30, 2019

(54) ELECTRICAL CONNECTOR GROUNDING AND POWER TERMINALS HAVING A BENT WIDENED SECTION

(71) Applicant: FOXCONN INTERCONNECT TECHNOLOGY LIMITED, Grand Cayman (KY)

(72) Inventors: Shao-Cong Zhou, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/012,422

(22) Filed: Jun. 19, 2018

(65) Prior Publication Data

US 2018/0366879 A1 Dec. 20, 2018

(30) Foreign Application Priority Data

Jun. 19, 2017 (CN) ..... 2017 1 0462069

(51) Int. Cl.

| | |
|---|---|
| ***H01R 13/6581*** | (2011.01) |
| ***H01R 13/04*** | (2006.01) |
| ***H01R 13/64*** | (2006.01) |
| ***H01R 24/60*** | (2011.01) |
| ***H01R 12/70*** | (2011.01) |

(Continued)

(52) U.S. Cl.

CPC ..... *H01R 13/6581* (2013.01); *H01R 12/7088* (2013.01); *H01R 13/04* (2013.01); *H01R 13/506* (2013.01); *H01R 13/64* (2013.01); *H01R 13/6474* (2013.01); *H01R 24/60* (2013.01); *H01R 12/724* (2013.01); *H01R 13/405* (2013.01); *H01R 2107/00* (2013.01)

(58) Field of Classification Search

CPC ..... H01R 13/6586; H01R 13/6587
USPC ..... 439/607.39, 607.4
See application file for complete search history.

(56) References Cited

U.S. PATENT DOCUMENTS 9,812,826 B2 * 11/2017 Yu ..... H01R 13/631
10,044,125 B2 * 8/2018 Qiu ..... H01R 12/7088

(Continued)

FOREIGN PATENT DOCUMENTS

CN 203813082 9/2014
CN 204118317 1/2015

(Continued)

*Primary Examiner* — Tulsidas C Patel
*Assistant Examiner* — Marcus E Harcum
(74) *Attorney, Agent, or Firm* — Wei Te Chung; Ming Chieh Chang

(57) ABSTRACT

An electrical connector includes: an insulative housing including a tongue; and plural conductive terminals retained to the insulative housing and arranged in two rows, the conductive terminals including plural grounding terminals and plural power terminals at outer ends of the two rows, each conductive terminal having a contacting section exposed to a surface of the tongue, a tail section, and an intermediate section between the contacting section and the tail section, wherein at least one of the grounding terminals and the power terminals has a widening section continuing and bent from the contacting section thereof to be embedded in the tongue portion, and a thickness of the widening section is substantially equal to a thickness of the contacting section.

4 Claims, 9 Drawing Sheets

(51) Int. Cl.

| | |
|---|---|
| ***H01R 13/506*** | (2006.01) |
| ***H01R 13/6474*** | (2011.01) |
| *H01R 13/405* | (2006.01) |
| *H01R 107/00* | (2006.01) |
| *H01R 12/72* | (2011.01) |

(56) References Cited

U.S. PATENT DOCUMENTS

| | | | | |
|---|---|---|---|---|
| 10,063,014 | B2 * | 8/2018 | Wen | H01R 13/04 |
| 2016/0099526 | A1 * | 4/2016 | Chen | H01R 13/5045 439/607.05 |
| 2017/0373439 | A1 | 12/2017 | Wen | |
| 2018/0019531 | A1 | 1/2018 | Qiu | |

FOREIGN PATENT DOCUMENTS

| | | |
|---|---|---|
| CN | 204243365 | 4/2015 |
| CN | 204304072 | 4/2015 |
| CN | 204315771 | 5/2015 |
| CN | 204391414 | 6/2015 |
| CN | 104810657 | 7/2015 |
| CN | 204696302 | 10/2015 |
| CN | 105024197 | 11/2015 |
| CN | 204966754 | 1/2016 |
| CN | 106025630 | 10/2016 |

* cited by examiner

ELECTRICAL CONNECTOR GROUNDING AND POWER TERMINALS HAVING A BENT WIDENED SECTION

BACKGROUND OF THE INVENTION

1. Field of the Invention

The present invention relates to an electrical connector including at least one grounding or power terminal having an integrated widened section that is bent to retain its thickness.

2. Description of Related Arts

China Patent No. 105024197, issued on Nov. 4, 2015, discloses an electrical connector including an insulative housing, an upper and lower rows of terminals, and a shell assembled to the insulative housing. The lower row of terminals include outermost grounding terminals and adjacent power terminals. A contacting section of each power terminal is so formed by tearing the material as to have a side section at a front thereof in order to widen the power terminal for large current conduction. Each grounding terminal has an integral side latch so as to do without a middle shielding plate otherwise provided between the two rows of terminals. China Patent Application Publication No. 106025630, published on Oct. 12, 2016, discloses an electrical connector including grounding and power terminals having similarly widened portions formed by a thinning operation instead.

SUMMARY OF THE INVENTION

An electrical connector comprises: an insulative housing including a tongue; and a plurality of conductive terminals retained to the insulative housing and arranged in two rows, the conductive terminals including a plurality of grounding terminals and a plurality of power terminals at outer ends of the two rows, each conductive terminal having a contacting section exposed to a surface of the tongue, a tail section, and an intermediate section between the contacting section and the tail section, wherein at least one of the grounding terminals and the power terminals has a widening section continuing and bent from the contacting section thereof to be embedded in the tongue portion, and a thickness of the widening section is substantially equal to a thickness of the contacting section.

DETAILED DESCRIPTION OF THE PREFERRED EMBODIMENT

Figure 1:
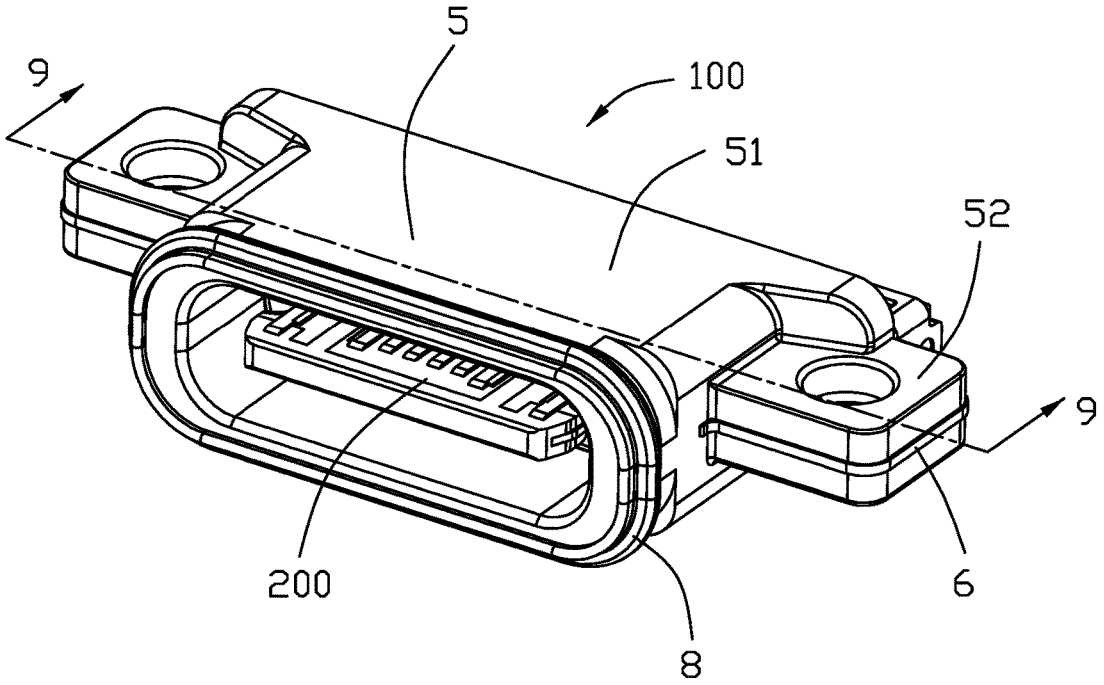
FIG. 1 is a front perspective view of an electrical connector in accordance with the present invention.
Figure 2:
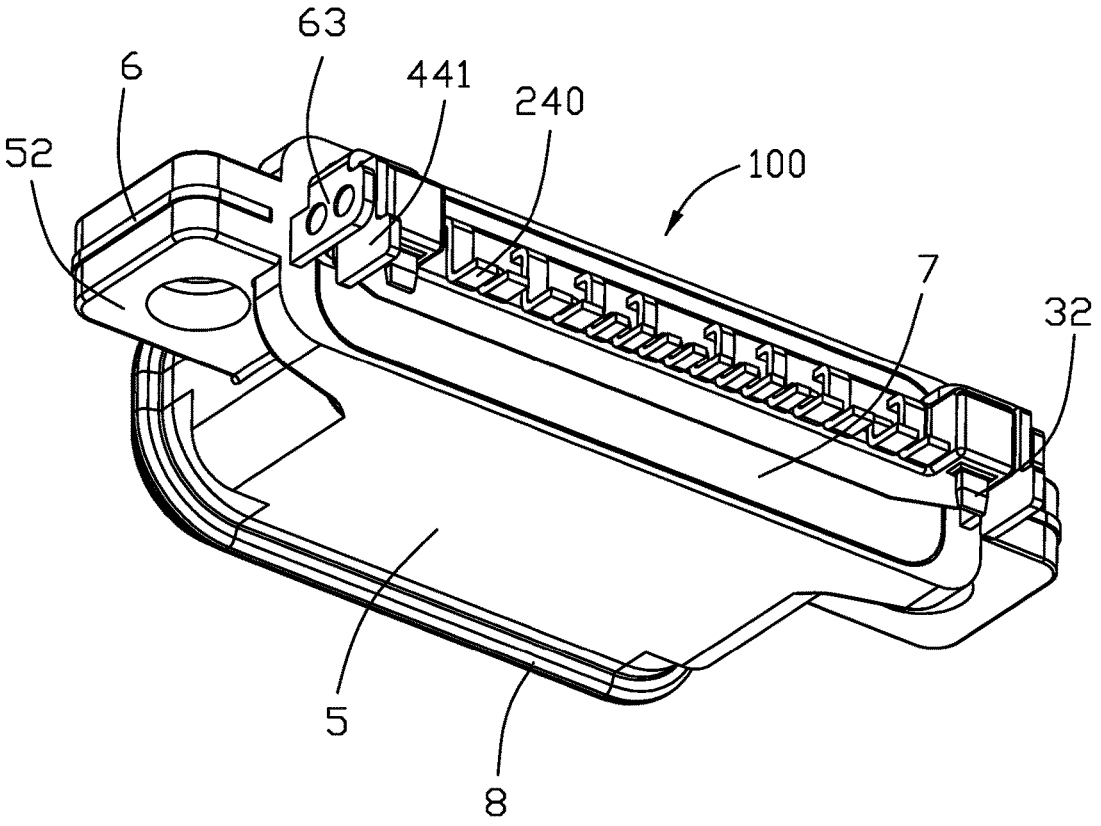
FIG. 2 is a rear perspective view of the electrical connector.

Referring to FIGS. 1 to 8, an electrical connector 100 includes a terminal module 200, a shielding shell 4 enclosing the terminal module 200, an insulative cover 5 molded over the shielding shell 4, a pair of reinforcing pieces 6 insert molded with the insulative cover 5, a sealing member 7, and a front sealing ring 8 disposed on the insulative cover 5. The terminal module 200 includes an insulative housing 1, two rows of conductive terminals 2 retained to the insulative housing 1, and a pair of metal pieces 3 between the two rows of conductive terminals 2.

Referring to FIGS. 3-8, the insulative housing 1 has a base 111, a front tongue, and a separate rear part 113. The insulative housing 1 includes a first insulator 11 and a second insulator 12. The first insulator 11 includes the base 111, a first tongue portion 112, and the rear part 113. The base 111 has recesses 1111. The rear part 113 has ribs 1131. The second insulator 12 has a second tongue portion 121. The first and second tongue portions 112 and 121 are molded to form an overall tongue of the insulative housing 1.

Figure 7:
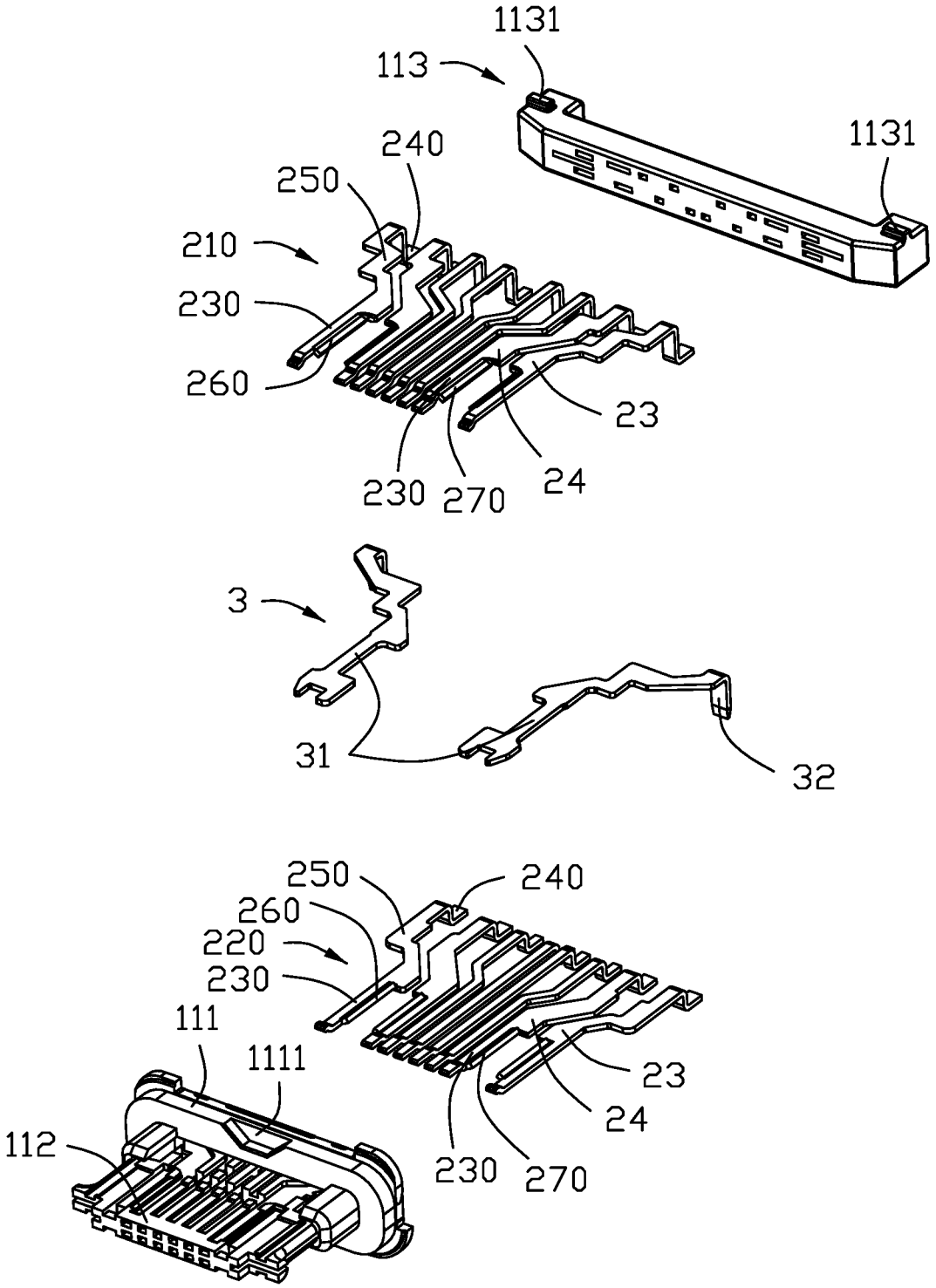
FIG. 7 is a further exploded view of a part of the terminal module.
Figure 8:
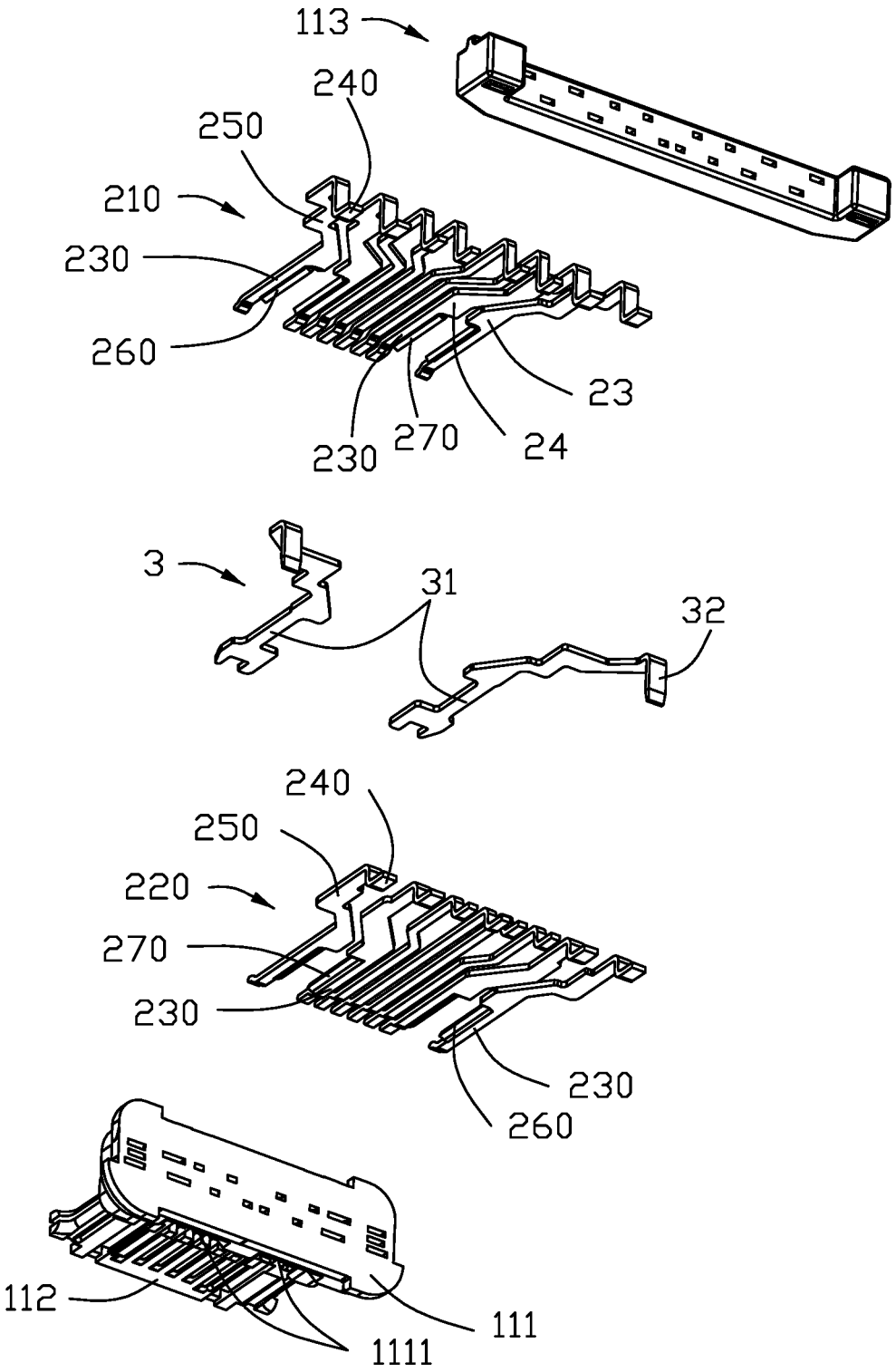
FIG. 8 is a view similar to FIG. 7 but from another perspective.
Figure 9:
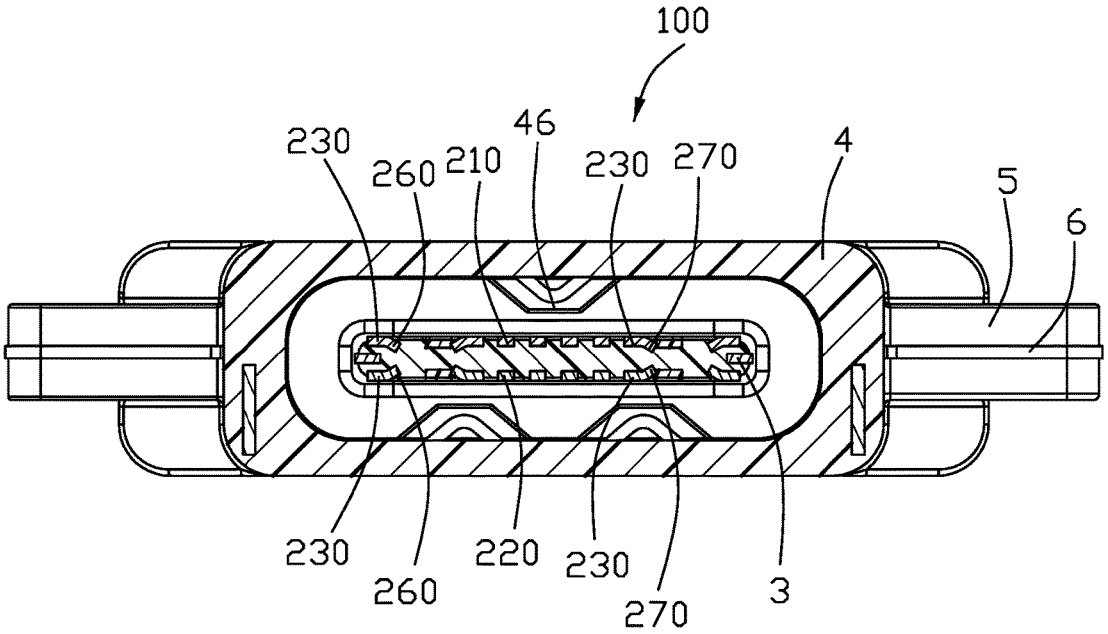
FIG. 9 is a cross-sectional view of the electrical connector taken along line A-A in FIG. 1.

Referring to FIGS. 7-8, the conductive terminals 2 are arranged in reverse symmetry in an upper row 210 and a lower row 220.

Each row 210 or 220 of conductive terminals include a pair of grounding terminals 23 at two outermost ends, a pair of power terminals 24 immediately inwardly of the pair of grounding terminals 23, and plural signal terminals. Each conductive terminal having a contacting section 230 exposed to a surface of the tongue of the insulative housing 1, a tail section 240 extending out of the base 111, and an intermediate section 250 between the contacting section 230 and the tail section 240. Each of the grounding terminals 23 has a widening section 260 continuing and bent about 30 to 45 degrees from the contacting section 230 thereof to be embedded in the tongue of the insulative housing 1. Each of the power terminals 24 has a widening section 270 continuing and bent about 30 to 45 degrees from the contacting section 230 thereof to be embedded in the tongue of the insulative housing 1. A combined width of the widening section 260 or 270 and associated contacting section 230 is about 0.5 mm to 0.75 mm. A thickness of the widening section 260 or 270 is substantially equal to a thickness of the contacting section 230. In the case of the upper row, for example, a free edge of the widening section 260 or 270 is leveled lower than a bottom face of associated contacting section 230. In the embodiment shown, the widening sections 260 and 270 of two adjacent grounding and power terminals 23 and 24 in each row are right across from each other.

Each of the metal pieces 3 has a main part 31 and a rear leg 32.

Figure 5:
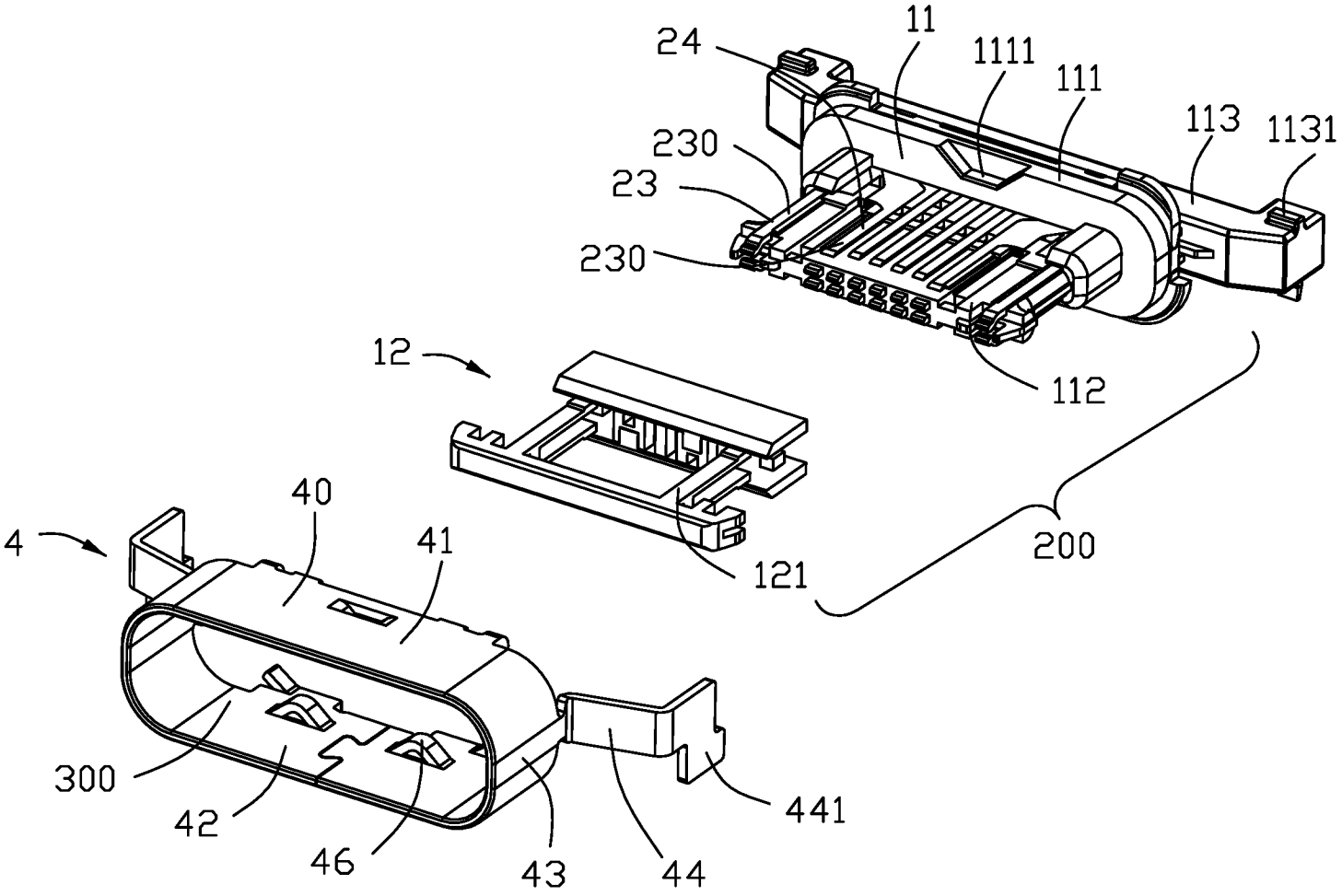
FIG. 5 is an exploded view of a terminal module and a shielding shell of the electrical connector.
Figure 6:
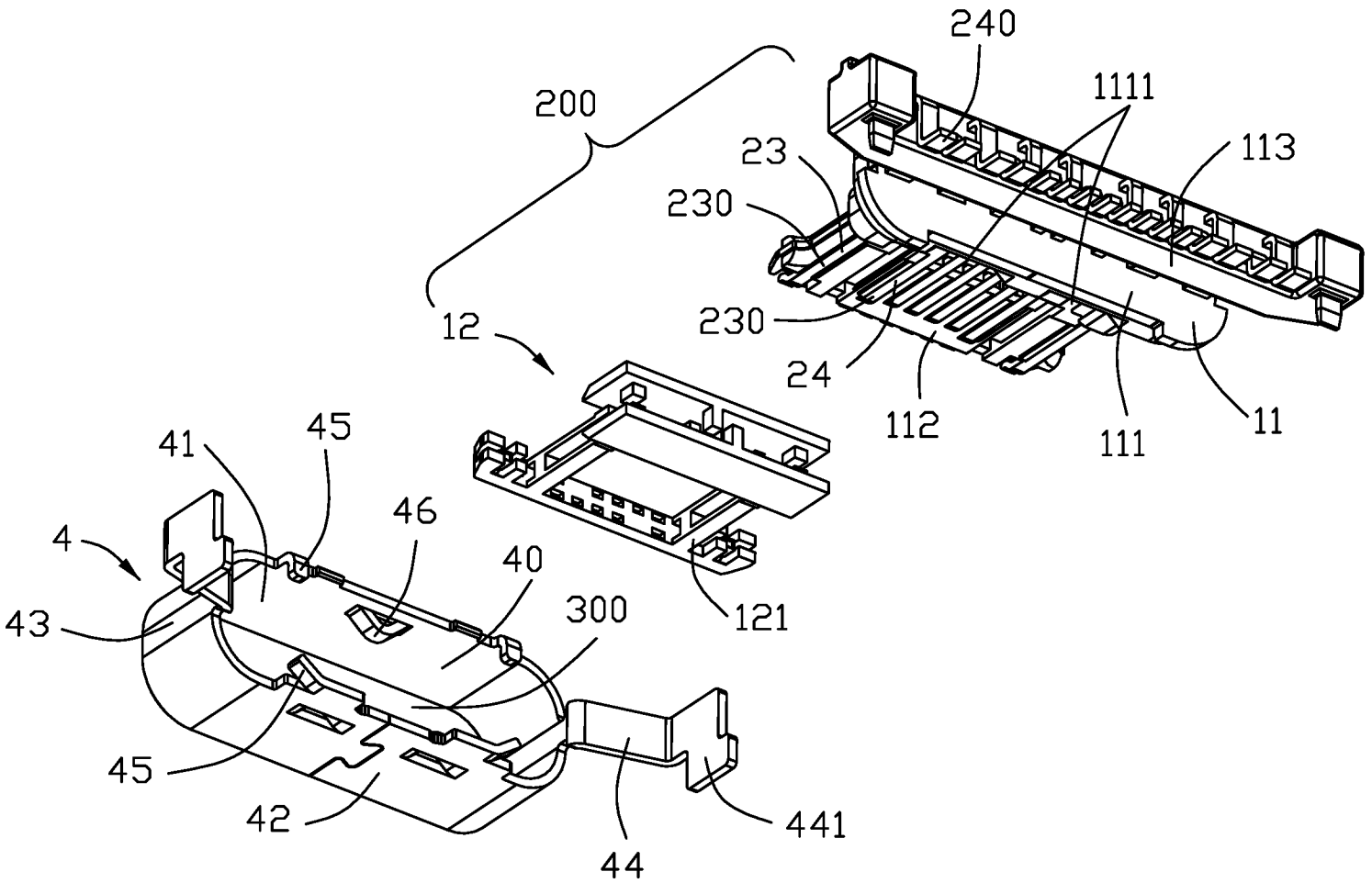
FIG. 6 is a view similar to FIG. 5 but from another perspective.

Referring to FIGS. 5-6, the shielding shell 4 includes a main part 40 defining a receiving cavity 300 and a pair of securing portions 44 each having a respective leg 441. The main part 40 has an upper wall 41, a lower wall 42, and a pair of side walls 43. Each of the upper and lower walls 41 and 42 has stoppers 45 and 46.

Figure 3:
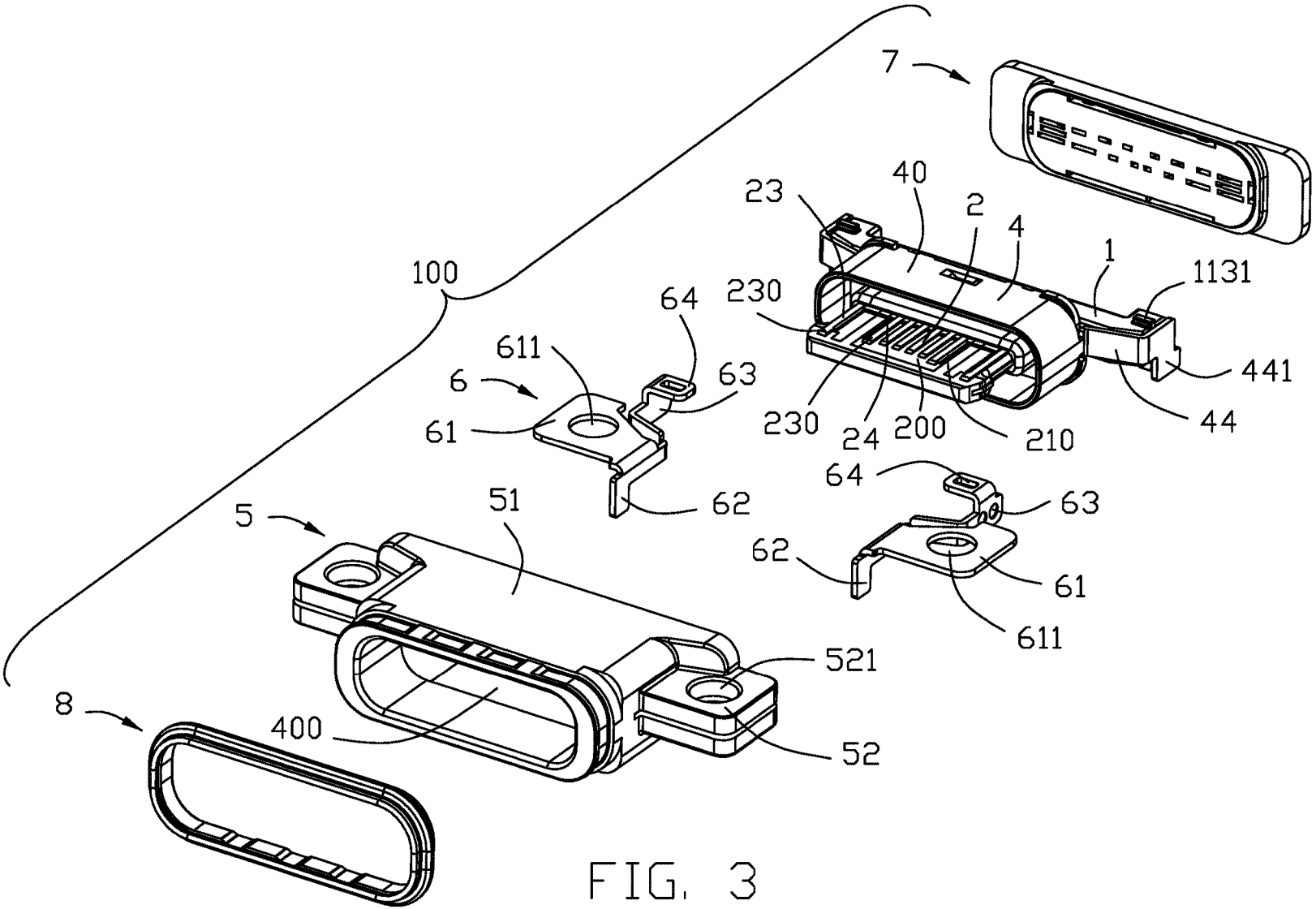
FIG. 3 is a partially exploded view of the electrical connector.
Figure 4:
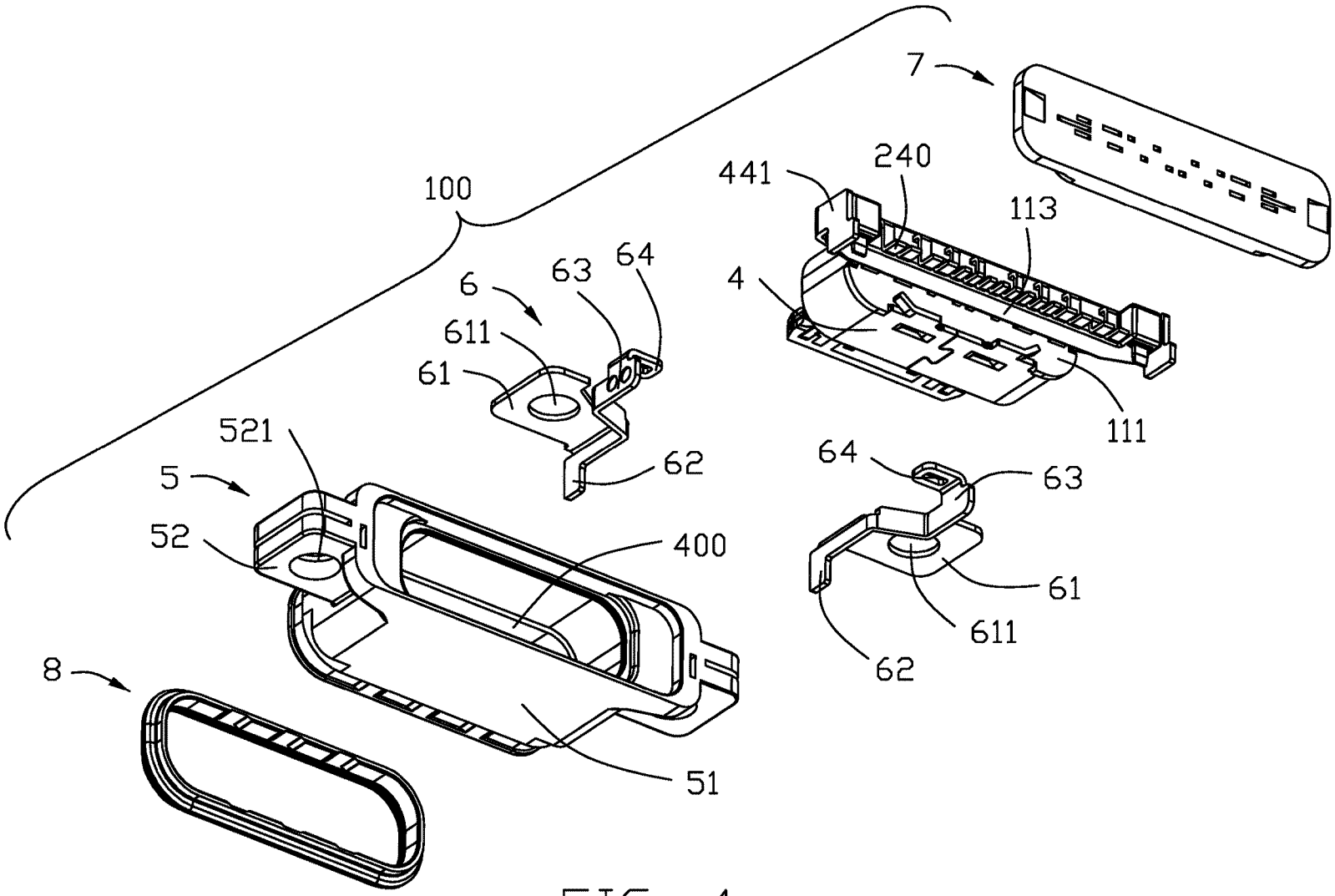
FIG. 4 is a view similar to FIG. 6 but from another perspective.

Referring to FIGS. 3-4, the insulative cover 5 includes a main part 51 defining a receiving cavity 400 and a pair of lugs 52 each having a respective hole 521.

The reinforcing piece 6 has a main part 61, a front leg 62, a rear body 63 for welding to a corresponding leg 441, and a latching portion 64 for engaging a corresponding rib 1131. The main part 61 has a hole 611.

The front sealing ring 8 is annular. The sealing member 7 fills a space between the base 111 and the rear part 113 of the insulative housing 1.

Formation of the widening portion on one or more ground terminals and/or power terminals by bending rather than shearing or thinning achieves a wider terminal for conducting large current while simplifying the forming operation. In other words, no other parts are linked to the outermost edge of the bent widening section so as to have the outer edge of the widening section embedded within the housing stably.

What is claimed is:

1. An electrical connector comprising:

an insulative housing including a tongue; and a plurality of conductive terminals retained to the insulative housing and arranged in two rows, the conductive terminals including a plurality of grounding terminals and a plurality of power terminals at outer ends of the two rows, each conductive terminal having a contacting section exposed to a surface of the tongue, a tail section, and an intermediate section between the contacting section and the tail section, wherein at least one of the grounding terminals and the power terminals has a widening section continuing and bent from the contacting section thereof to be embedded in the tongue portion, a thickness of the widening section is substantially equal to a thickness of the contacting section, each row of conductive terminals include a pair of grounding terminals at two outermost ends and a pair of power terminals immediately inwardly of the pair of grounding terminals, each of the grounding terminals and the power terminals in each row has a widening section continuing and bent from the contacting section thereof to be embedded in the tongue, and the widening sections of two adjacent grounding and power terminals in each row are across from each other.

2. The electrical connector as claimed in claim 1, wherein the widening section is bent about 30 to 45 degrees.

3. An electrical connector comprising:

an insulative housing forming a tongue defining opposite mating surfaces in a vertical direction; and two rows of terminals retained in the housing, a power terminal and a grounding terminal being located at either end of each row of said two rows of terminals in a transverse direction perpendicular to said vertical direction, each of said two rows of terminals including a contacting section exposed upon the corresponding mating surface, and a tail section exposed outside of the housing, and an intermediate section between the contacting section and the tail section in a front-to-back direction perpendicular to both said vertical direction and said transverse direction, the contacting sections of all said terminals having a same width thereof in said transverse direction; wherein a width of said intermediate section is larger than that of the contacting section in each of the power terminals and the grounding terminals; wherein a widening section unitarily extends from a side edge of the contacting section of at least one of said power terminal and said grounding terminal in one row at an oblique angle toward the other row viewed along the front-to-back direction; wherein an outer edge of the widening section is directly embedded within the tongue without other parts extending therefrom.

4. The electrical connector as claimed in claim 3, wherein front ends of the power terminal and the grounding terminal in one row are deflected toward those in the other row.

* * * * *